US011695237B2

(12) United States Patent
Urtz, Jr. et al.

(10) Patent No.: US 11,695,237 B2
(45) Date of Patent: Jul. 4, 2023

(54) ANNULAR ABUTMENT/ALIGNMENT GUIDE FOR CABLE CONNECTORS

(71) Applicant: John Mezzalingua Associates, LLC, Liverpool, NY (US)

(72) Inventors: Thomas Sawyer Urtz, Jr., North Syracuse, NY (US); Jeremy Charles Benn, Baldwinsville, NY (US); Nic Olivares, Brewerton, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 202 days.

(21) Appl. No.: 17/047,579

(22) PCT Filed: Apr. 17, 2019

(86) PCT No.: PCT/US2019/027913
§ 371 (c)(1),
(2) Date: Oct. 14, 2020

(87) PCT Pub. No.: WO2019/204476
PCT Pub. Date: Oct. 24, 2019

(65) Prior Publication Data

US 2021/0119381 A1 Apr. 22, 2021

Related U.S. Application Data

(60) Provisional application No. 62/658,743, filed on Apr. 17, 2018.

(51) Int. Cl.
*H01R 13/631* (2006.01)
*H01R 24/40* (2011.01)
*H01R 103/00* (2006.01)

(52) U.S. Cl.
CPC ..... *H01R 13/631* (2013.01); *H01R 24/40* (2013.01); *H01R 2103/00* (2013.01)

(58) Field of Classification Search
CPC ..... H01R 13/646; H01R 9/05; H01R 13/631; H01R 24/40; H01R 2103/00; H01R 13/641; H01R 13/622
See application file for complete search history.

(56) References Cited

U.S. PATENT DOCUMENTS 8,414,326 B2 * 4/2013 Bowman ..... H01R 24/42 439/913
8,419,464 B2 * 4/2013 Montena ..... H01R 24/42 439/489

(Continued)

FOREIGN PATENT DOCUMENTS

JP 2003-516606 A 5/2003
WO 2017220639 A1 12/2017

OTHER PUBLICATIONS

International Searching Authority, International Search Report and Written Opinion, Date of Completion: Aug. 9, 2019; dated Aug. 9, 2019; 10 pages.

(Continued)

*Primary Examiner* — Abdullah A Riyami
*Assistant Examiner* — Nader J Alhawamdeh
(74) *Attorney, Agent, or Firm* — Barclay Damon LLP

(57) ABSTRACT

A connector comprises an inner conductor, an outer conductor basket and an annular abutment/alignment guide disposed therebetween. The inner conductor socket transmits RF signals from one connector portion to another connector portion across a mating interface. The outer conductor basket comprises a plurality of axially projecting fingers operative to electrically ground the connector. The annular abutment comprises an outwardly facing abutment surface and an alignment guide disposed integrally with the annular abutment. The alignment guide has a flanged end portion projecting: (i) radially outboard from an upper or forward end of the annular abutment and (ii) over the tip (Continued)

FIG. 1 ends of each axially projecting basket finger. The annular abutment: (a) inhibits inward radial displacement of the axially projecting fingers, (b) prevents plastic deformation of the basket fingers upon annular abutment of a non-mating connector, and (c) aligns a mating connector so as to prevent damage to the basket fingers upon joining the mating connector.

23 Claims, 6 Drawing Sheets

(56) References Cited

U.S. PATENT DOCUMENTS

| | | | | |
|---|---|---|---|---|
| 8,591,254 | B1 * | 11/2013 | Chawgo | H01R 24/38 439/585 |
| 9,083,113 | B2 * | 7/2015 | Wild | H01R 13/623 |
| 9,761,963 | B1 * | 9/2017 | Matsumoto | H01R 9/0527 |
| 10,122,131 | B2 * | 11/2018 | Stevens | H01R 24/40 |
| 2007/0232088 | A1 | 10/2007 | Burris et al. | |
| 2010/0186228 | A1 | 7/2010 | Montena | |
| 2011/0077884 | A1 * | 3/2011 | Bowman | H01R 24/42 702/66 |
| 2011/0130034 | A1 * | 6/2011 | Montena | H01R 24/42 439/578 |
| 2012/0252265 | A1 * | 10/2012 | Wild | H01R 24/564 439/578 |
| 2012/0252282 | A1 | 10/2012 | Maki | |
| 2016/0322751 | A1 * | 11/2016 | Van Swearingen | H01R 13/64 |
| 2016/0336676 | A1 * | 11/2016 | Stevens | H01R 13/6583 |
| 2021/0066841 | A1 * | 3/2021 | Stevens | H01R 13/05 |
| 2021/0119381 | A1 * | 4/2021 | Urtz | H01R 13/631 |

OTHER PUBLICATIONS

International Pleliminary Examining Authority, International Preliminary Report on Patentability, dated Aug. 20, 2020, 10 pages.
European Patent Office, Extended European Search Report, Application No. 19788793.8, Patent No. 3782241, dated Dec. 23, 2021 (10 pages).
Australian Intellectual Property Office; Examination Report No. 1; Application No. 2019255296; Date of Report: Aug. 30, 2022; 3 pages.

* cited by examiner

ANNULAR ABUTMENT/ALIGNMENT GUIDE FOR CABLE CONNECTORS

BACKGROUND

Telecommunications systems often employ hardline connectors for data transfer between telecom components, e.g., a Remote Radio Unit (RRU) and a telecommunications sector antenna. These hardline connectors often employ an arrangement of spring-biased fingers/elements for making the requisite electrical connections, e.g., signal or electrical ground connections, from one connector to a mating connector. One type of connector, known as a 4.3-10 Connector, commonly employs a multi-fingered inner conductor socket surrounded by a multi-fingered outer connector basket which receive an inner conductor pin and an outer conductor sleeve, respectively, of an adjoining/opposing connector.

The geometric similarity between connectors, in combination with the difficulty associated with physically making an electrical connection, i.e., fifty (50) feet in the air, can cause Linemen to improperly/incorrectly join connectors. While connectors which do not properly mate will, in most instances, not be able to be joined (i.e., to affect a viable telecommunications connection), the attempt alone can damage or, otherwise distort, at least one of the conductors.

Particularly vulnerable are the fingers of the outer conductor basket. For example, a Mini-Din connector, which is also an RF connector used in the telecommunications industry, is sufficiently similar in appearance that one might inadvertently try to connect a Mini-Din plug to a 4.3-10 jack. Unfortunately, in applying force to establish the connection, the structure of the Mini-Din plug may press against and force outward the finger elements of the 4.3-10 outer conductor basket. Not only would this cause an improper RF connection, it would damage the 4.3-10 jack, requiring that it be replaced. Inasmuch as the connector is, most often, an integral component of an electronic component, e.g., a Remote Radio Unit or an antenna, a seemingly small amount of damage to the connector can incapacitate a very costly piece of telecommunications equipment, i.e., ranging from $20K to $40K to replace.

Therefore, a need exists to overcome, or otherwise lessen the effects of, the disadvantages and shortcomings described above.

BRIEF DESCRIPTION OF THE DRAWINGS

Additional features and advantages of the present disclosure are described in, and will be apparent from, the following Brief Description of the Drawings and Detailed Description.

SUMMARY OF THE INVENTION

Figure 1:
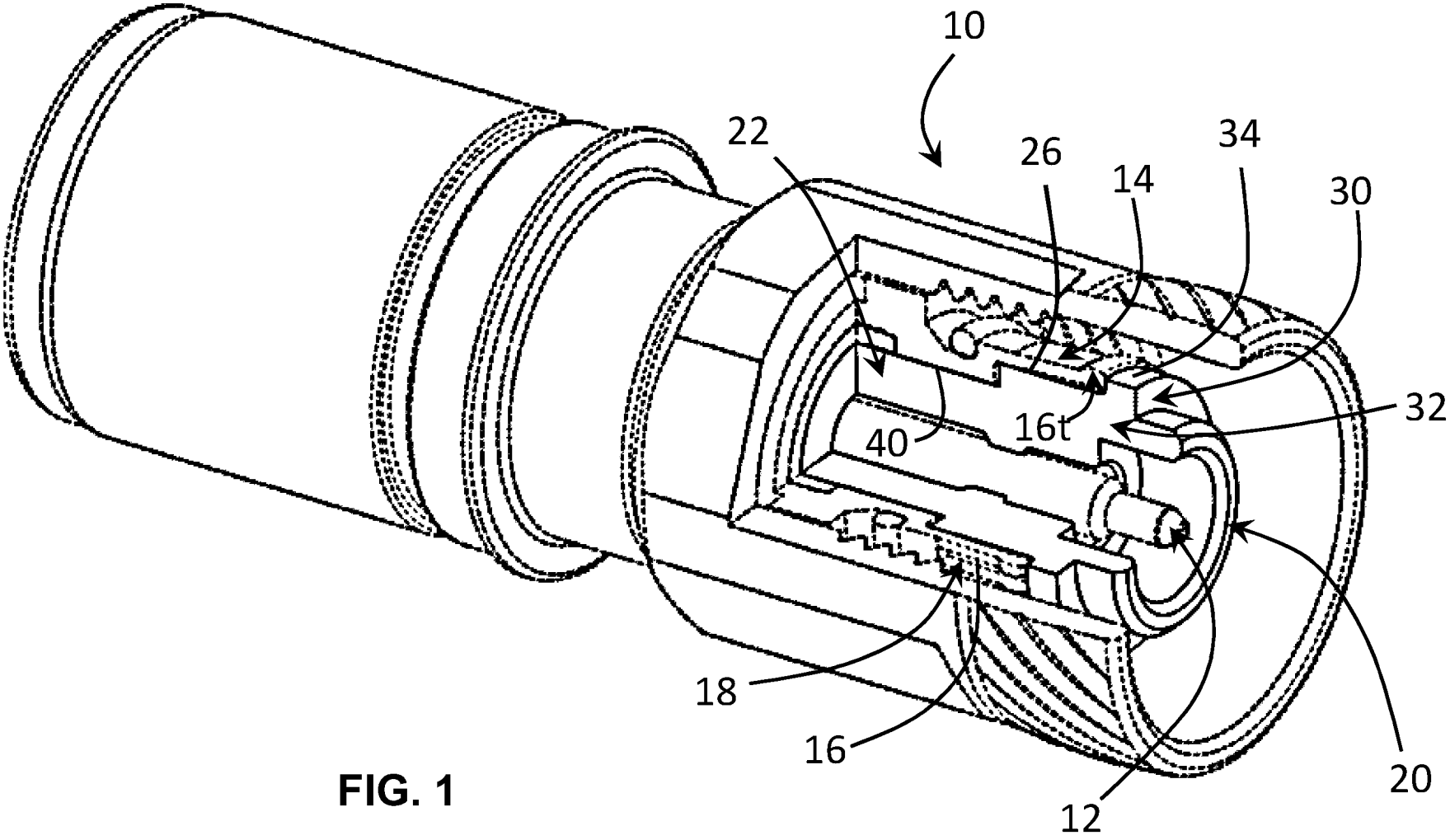
FIG. 1 is perspective end view of a connector including an annular abutment disposed between an inner connector pin and an outer conductor basket of an RF connector.
Figure 2:
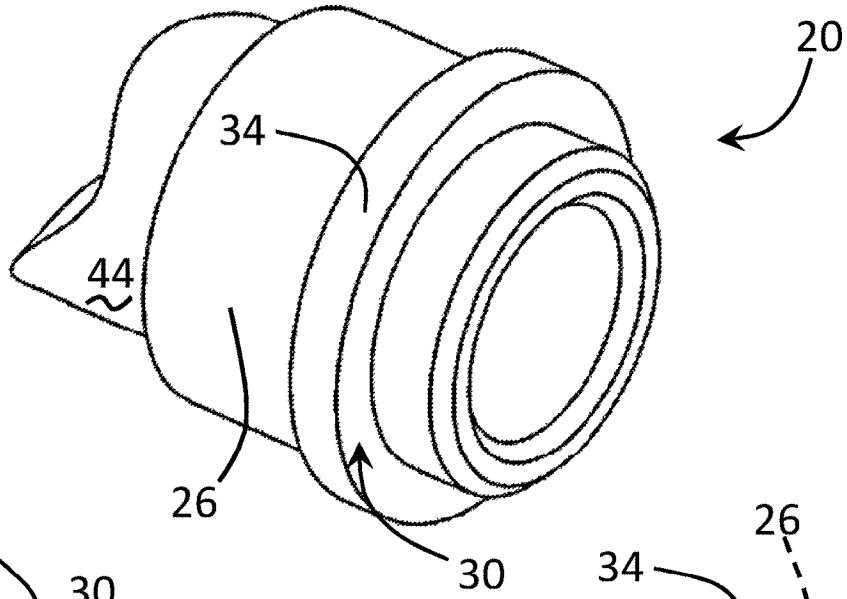
FIG. 2 is an isolated perspective view of the annular abutment of the connector including an annular abutment surface and an alignment guide at the tip end portion of the annular abutment.

In one embodiment of the disclosure, a connector is provided comprising a center or inner conductor, an outer conductor basket and an annular abutment/alignment guide disposed therebetween. The inner conductor socket transmits RF signals from one connector to another across a mating interface. The outer conductor basket comprises a plurality of axially projecting fingers operative to electrically ground the connector. The annular abutment comprises an outwardly facing abutment surface and an alignment guide disposed integrally with the annular abutment. The annular abutment surface projects from a base of the connector between the inner conductor and outer conductor basket. The alignment guide includes a flanged end portion projecting: (i) radially outboard from an upper or forward end of the annular abutment, and (ii) over, or forward of, the tip ends of each axially projecting basket finger. The annular abutment: (a) inhibits inward radial displacement of the axially projecting fingers, (b) prevents plastic deformation of the basket fingers upon annular abutment of a non-mating connector, and (c) aligns a mating connector so as to prevent damage to the basket fingers upon annular abutment of the mating connector.

In one embodiment, the annular abutment is integral with the connector base and in another embodiment, the annular abutment is separate from, and non-integral with the base. In the latter embodiment, the annular abutment is press-fit against an inwardly facing surface of the connector base.

DETAILED DESCRIPTION

A connector is described including first and second connectors or connector portions each comprising electrically-connecting inner and outer conductors. While the connector includes first and second mating connector portions, it should be understood and appreciated that, in the context used herein, a "connector" means either or both of the connector portions.

The following describes a connector, for example, a 4.3-10 connector, and a protective annular abutment for inhibiting, mitigating or reducing damage which may or can occur to a multi-fingered spring-biased outer conductor basket of the connector. The 4.3-10 connector 10 of the type described herein may have an impedance of about fifty Ohms (50Ω) with a frequency range of between about one Kilo-Hertz (0.1 GHz) to about six Giga-Hertz (6 GHz.), although variations to the connector parameters are possible and within the scope of the disclosure. Such connectors are available for purchase under the model designations 4.3-10 from JMA Wireless Inc., (a world-class industry leader in the design, fabrication, and supply of wireless RF telecommunications products) located in Liverpool, State of New York.

While the protective annular abutment is particularly useful for 4.3-10 connectors, it will be appreciated that the protective annular abutment, and the teachings associate therewith, are equally applicable to a wide-variety of telecommunications/signal connectors. The protective annular abutment of the present disclosure has utility upon assembly of the 4.3-10. Specifically, the annular abutment prevents damage to the basket fingers by guiding a mating connector over the basket fingers, especially when the connectors are presented or mated at a large angle of inclination.

In FIG. 1, a connector 10 includes a central or inner conductor 12 surrounded by an outer conductor basket 14 comprising a plurality of axially projecting basket fingers 16. A protective annular abutment 20 is disposed in combination with the connector 10 and, in the described embodiment, projects from an annular base 22 of the connector 10. As will be understood from the subsequent discussion, the annular abutment 20 may be a separate element, or component, with respect to the annular base 22, or may be integrally formed therewith.

In FIGS. 2-5, the annular abutment 20 includes an outwardly facing abutment surface 26 and an alignment guide 30 integrally formed with an upper end portion 32 of the annular abutment 20. The outwardly facing abutment surface 26 is configured to inhibit inward radial displacement of the axially projecting fingers 16. The alignment guide 30 comprises a flanged portion projecting radially outboard from the upper end portion 32 of the annular abutment 20 and includes an alignment or guide surface 34 disposed over or forward of the tip ends 16*t* of the axially projecting fingers 16 of the outer conductor basket 14. The guide surface 34 of the alignment guide 30 is configured to align a pair of connectors as they are joined together and caused to mate along an interface.

Figure 4:
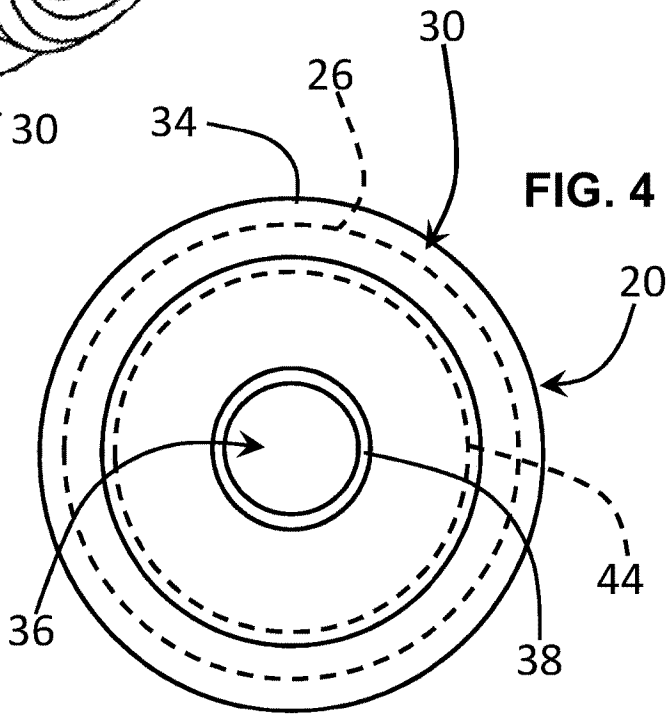
FIG. 4 is an front view of the annular abutment of the connector.
Figure 5:
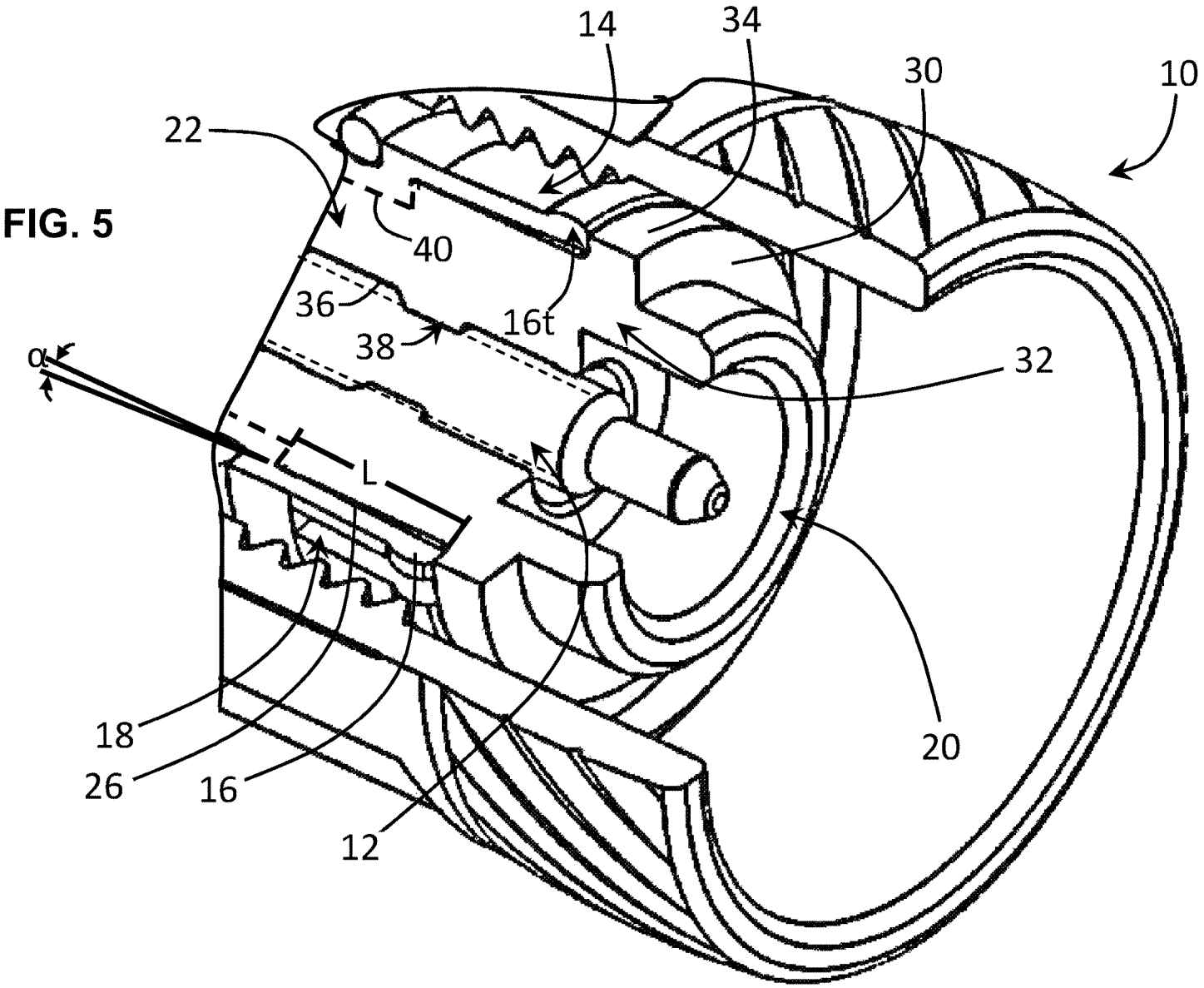
FIG. 5 is an enlarged, partially sectioned, broken-away perspective view of the connector.

In FIGS. 4 and 5, the outwardly facing annular abutment surface 26 is disposed in opposing relationship to the back-side surface of the basket fingers 16. In the described embodiment, the length L of the outwardly facing annular abutment surface 26 generally corresponds to the length dimension of the basket fingers 16. Furthermore, the annular abutment surface 26 defines an angle $\alpha$ relative, or with respect, to the back-side surface of the basket fingers 16. The angle $\alpha$ is shallow and is generally less than about seven degrees (7.0°), and, in the preferred description, is less than about five degrees (5.0°).

The annular abutment 20 defines a central bore 36 for receipt of the inner conductor or pin 12, and, in the described embodiment, forms an annular ring or annular abutment 38 configured to engage, and center, the pin 12 within the annular abutment 20. As such, only a small circumferential ring comes into contact with the signal transmitting pin 12, thus minimizing the probability of inducing interference.

Figure 6:
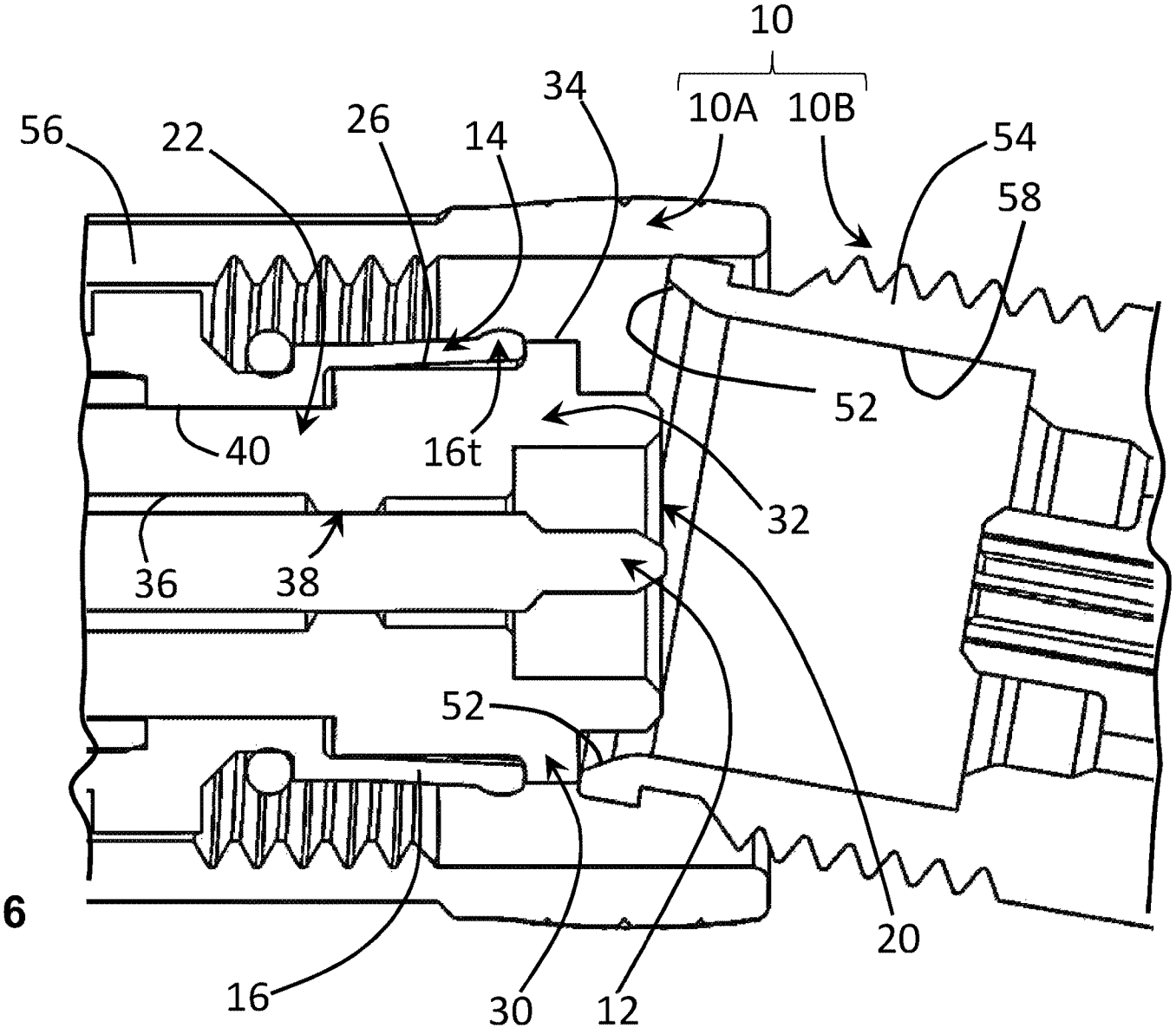
FIG. 6 is a sectional view of mating connectors being joined at an angle of inclination depicting the annular abutment as it guides and protects the axially projecting fingers of the outer conductor basket.

FIG. 6 depicts a view of the first and second connectors 10A and 10B being joined at a potentially problematic or damaging angle or inclination. The figure shows a tapered end 52 of an outer conductor ring 54 of the second connector 10B being guided into alignment by the surface 34 of the alignment guide 30. As such, the tapered end 52 of the outer conductor ring 54 is guided over the tip ends 16*t* of the basket fingers 16 while the guide surface 34 promotes realignment of the connectors 10A and 10B.

Figure 7A:
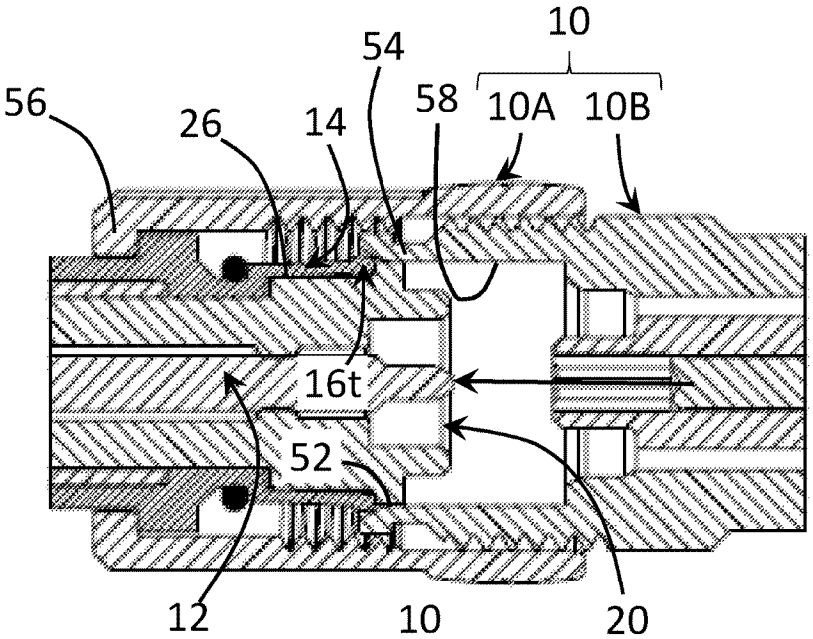
FIGS. 7A and 7B depict cross-sectional views of a first and second mating connector being joined along a mating interface wherein the alignment guide of the first connector centers the flared conical conductor ring of the second connector (as seen in FIG. 7A) and wherein the annular abutment inhibits inward radial displacement of the axially projecting fingers of the outer conductor basket of the first mating connector as the second mating connector is joined along the mating interface (as seen in FIG. 7B).
Figure 7B:
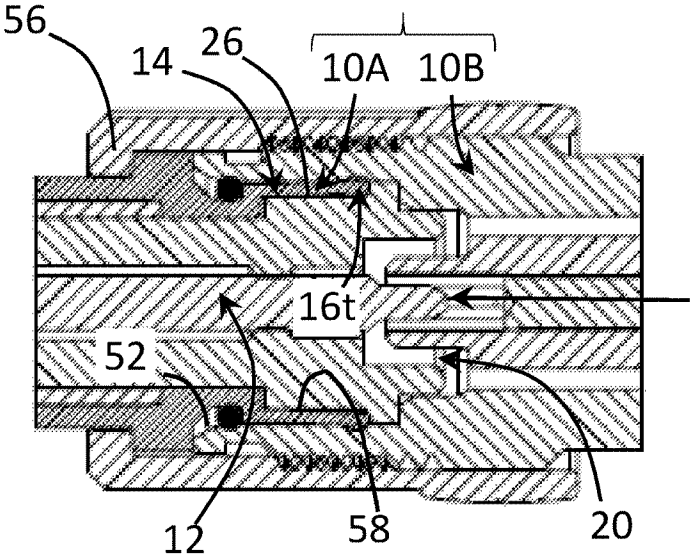

FIGS. 7A and 7B depict views of mating connectors 10, i.e., a first connector 10A and a second connector 10B, being joined along a mating interface. In FIG. 7A, the alignment guide 30 of the first connector 10A centers the flared conductor sleeve or ring 54 of the second connector 10B upon insertion between the coupling member 56 and the basket fingers 16. In FIG. 7B, the flared conductor ring 54 is fully inserted thereby causing the outwardly biased basket fingers 16 to contact the conductive inner surface 58 of the ring 54. Therein, the annular abutment surface 26 inhibits inward radial displacement of the axially projecting fingers 16 of the outer conductor basket 14.

Figure 3:
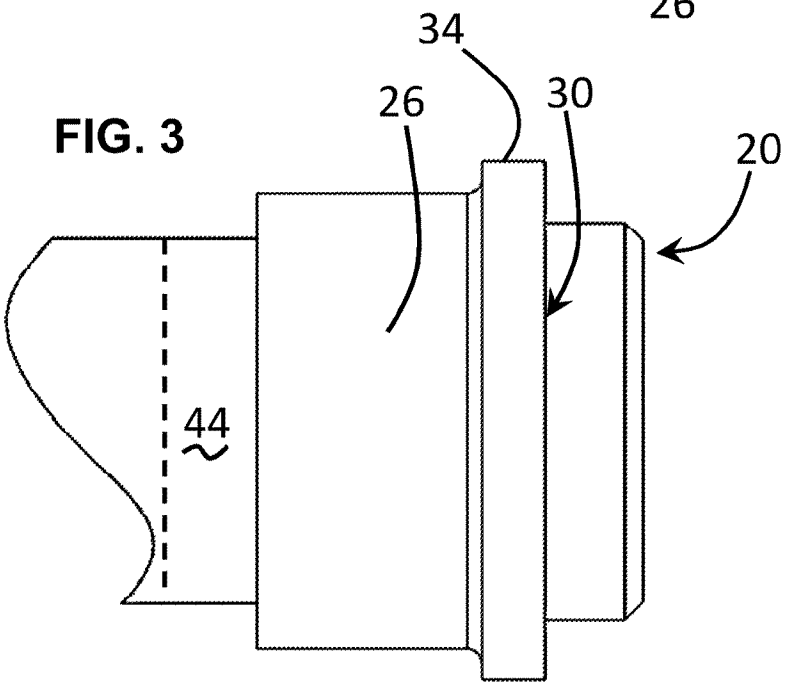
FIG. 3 is an isolated profile view of the annular abutment of the connector.

The annular abutment 20 may be integrally formed with the body of the connector 10 or formed as a separate, isolated element. FIG. 5 shows the annular abutment 20 as an integral element, projecting from an annular base of the connector. Alternatively, the dashed lines of FIGS. 3 and 5 show the annular abutment 20 as a separate element. In this embodiment, an outwardly facing press-fit surface 44 of the abutment 20 mates with an inwardly facing surface 42 of the connector body 10, i.e., at the connector base 22. The annular abutment 20 is preferably fabricated from a dielectric material so as to minimize its impact on the impedance properties of the connector 10. That is, the annular abutment 20 should be fabricated from materials which maintain the impedance at the desired fifty Ohms (500) within a frequency band of between about one Kilo-Hertz (0.1 GHz) to about six Giga-Hertz (6 GHz.)

Figure 8:
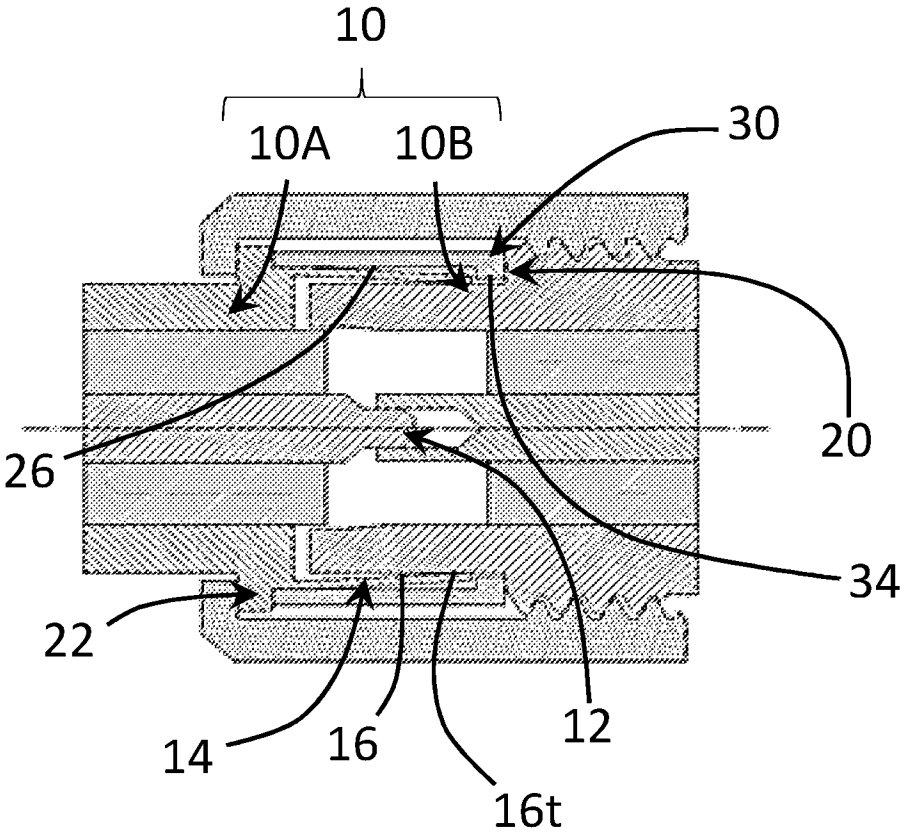
FIG. 8 depicts another embodiment of the disclosure wherein the annular abutment is disposed radially outboard of the outer conductor basket, wherein the axially projecting fingers are radially biased inwardly, wherein the abutment surface prevents plastic deformation of the basket fingers in an outwardly direction and wherein the alignment guide defines an inwardly facing surface configured to guide the mating connector over the tip ends of the basket fingers as a mating connector is joined along a mating interface.

Another embodiment of the disclosure is depicted in FIG. 8 wherein the basket fingers 16 of one connector 10A are disposed between the inner conductor 12 and the annular abutment 20. In this embodiment, the annular abutment 20 projects axially from the annular base 22 and is disposed radially outboard of the basket fingers 16. An inwardly facing abutment surface 26 is spaced apart from, and opposes, the back-side surface of each axially projecting finger 16. Furthermore, the annular abutment 20 includes an alignment guide 30 having a surface configured to guide a mating connector 10B over the tip end portion 16*t* of the basket fingers 16. More specifically, the alignment guide 30 projects radially inwardly and is configured to be disposed over, or forward of, the tip end portion of each basket finger 16.

Similar to the previously described embodiment, the annular abutment 20 prohibits outward plastic deformation of the basket fingers 16*t* while the alignment guide 30 is configured to prevent misalignment of the connectors 10 and damage to the basket fingers 16 as the first connector 10A is joined to the second connector 10B along a mating interface.

In summary, the annular abutment 20 protects the basket fingers 16 from being displaced radially, i.e., both inwardly and outwardly, beyond the elastic limits or properties of the basket fingers 16. The abutment surface 26 of the annular abutment prevents the basket fingers 16 from being plastically deformed inwardly beyond the initial outward bias of the fingers 16. That is, the basket fingers 16 are biased outwardly so as to form the angular relationship between the basket fingers 16 and the abutment surface 26. The angle $\alpha$ is selected so as to maintain the outward angular bias of the basket fingers, i.e., without degrading or plastically deforming the basket fingers 16 inwardly. On the other hand, the alignment guide 30 of the annular abutment 20 also protects the basket fingers 16 from being displaced radially outwardly in a similarly damaging manner. Inasmuch as the guide surface 34 is disposed radially outboard of the tip ends

16*t* of the basket fingers 16, a mating connector surface 52 may be forced over the basket fingers 16 rather than beneath, or under, the fingers 16. As a result, a mating connector cannot be inserted in a manner which would plastically deform the basket fingers 16 outwardly, i.e., potentially damaging the fingers 16.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. In a connector having a pair of connectors operative to transmit RF signals across an interface, at least one of the connectors, comprising:

an inner conductor surrounded by an outer conductor basket, the outer conductor basket having a plurality of axially projecting fingers separated by an axial slot between adjacent fingers;

an annular abutment projecting axially from an annular base between a socket and the basket, the annular abutment comprising:

an outwardly facing abutment surface opposing a back-side surface of the axially projecting fingers; and an alignment guide integral with the annular abutment and comprising a flanged end portion projecting radially outboard from an upper end portion of the annular abutment and configured to be disposed forward of tip ends of each basket finger;

wherein the outwardly facing abutment surface is configured to prevent radially inward displacement, and plastic deformation, of the basket fingers, and wherein the alignment guide is configured to align mating connectors upon joining the connectors.

2. The connector of claim 1 wherein the annular abutment is separate from the annular base.

3. The connector of claim 1 wherein the annular abutment is integral with the annular base.

4. The connector of claim 2 wherein the annular abutment is press fit against an inwardly facing annular surface of the annular base.

5. The connector of claim 1 wherein a length of the abutment surface corresponds an engagement length of the axially projecting fingers.

6. The connector of claim 1 wherein the alignment guide centers an outer conductor ring of a mating connector over the basket fingers of the at least one of the connectors.

7. The connector of claim 1 wherein the abutment surface forms an angle with respect to the back-side surface of each axially projecting finger of the outer conductor basket.

8. The connector of claim 1 wherein the annular abutment centers the inner conductor of the connector.

9. The connector of claim 8 wherein the annular abutment includes a central bore for receiving the inner conductor and includes an inwardly projecting circumferential ring for engaging and centering an outer peripheral surface of the inner conductor.

10. The connector of claim 9 wherein each axially projecting finger includes an outwardly projecting ridge for electrically connecting to an inwardly facing surface of the outer conductor ring upon joining mating connectors.

11. An annular abutment configured to prevent damage to at least one axially projecting finger of an outer conductor basket associated with an RF connector, comprising:

an annular abutment defining an outwardly facing abutment surface configured to define a shallow angle with respect to a back-side surface of the axially projecting fingers of an outer conductor basket of a connector; and an alignment guide integral with the annular abutment and comprising a flanged end portion projecting radially outboard from an upper end portion of the annular abutment and configured to be disposed over tip ends of each basket finger;

wherein the outwardly facing abutment surface is configured to prevent radially inward displacement, and plastic deformation, of the basket fingers, and wherein the alignment guide is configured to align mating connectors upon joining connectors.

12. The annular abutment of claim 11 wherein the annular abutment includes an outwardly facing press-fit surface configured to be press fit against an inwardly facing annular surface of the annular base.

13. The annular abutment of claim 11 wherein a length of the abutment surface corresponds an engagement length of the axially projecting fingers.

14. The annular abutment of claim 11 wherein the alignment guide is configured to center an outer conductor ring of a mating connector.

15. The annular abutment of claim 11 wherein the abutment surface forms an angle a with respect to the back-side surface of each axially projecting finger of the outer conductor basket.

16. The annular abutment of claim 5 wherein the angle a is less than about seven degrees (7.0°).

17. The annular abutment of claim 11 wherein the annular abutment comprises a body that is composed of a dielectric material.

18. The annular abutment of claim 11 further comprising a tubular body having a central bore for receiving an inner conductor, the central bore including an inwardly projecting circumferential ring for centering an outer peripheral surface of the inner conductor.

19. In a connector having a pair of connectors operative to transmit RF signals across a mating interface, at least one of the connectors, comprising:

an inner conductor surrounded by an outer conductor basket, the outer conductor basket having a plurality of axially projecting fingers separated by an axial slot between adjacent fingers;

an annular abutment projecting axially from an annular base, radially outboard of the outer conductor basket, the annular abutment comprising:

an inwardly facing abutment surface spaced apart from and opposing a back-side surface of the axially projecting fingers; and an alignment guide integral with the annular abutment and comprising a flanged end portion projecting radially inward from an upper end portion of the annular abutment and configured to be disposed forward of tip ends of each basket finger;

wherein the inwardly facing abutment surface is configured to prevent radially outward displacement, and plastic deformation, of the basket fingers, and wherein the alignment guide is configured to align mating connectors upon joining the connectors.

20. The connector of claim 19 wherein the annular abutment is separate from the annular base.

21. The connector of claim 19 wherein the annular abutment is integral with the annular base.

22. A method for preventing an inadvertent coupling improperly or non-mating connector portions, one of the connector portions having an inner conductor for transmitting RF signals across a connector interface and an outer conductor basket having at least one axially projecting finger to electrically ground the connector portions; the method including the steps of:

structuring the one of the connector portions to comprise an annular abutment projecting axially from an annular base between a socket and the conductor basket, the annular abutment comprising:

an outwardly facing abutment surface opposing a back-side surface of the axially projecting fingers; and an alignment guide formed integrally with the annular abutment and comprising a flanged end portion projecting radially outboard from an upper end portion of the annular abutment and configured to be disposed forward of tip ends of each basket finger wherein the outwardly facing abutment surface is configured to prevent radially inward displacement, and plastic deformation, of the basket fingers, and wherein the alignment guide is configured to align mating connectors upon joining the connectors.

23. The method of claim 22 further comprising the step of securing the annular abutment to connector by press fitting annular abutment to an outwardly facing surface of the connector.

* * * * *